US009526997B2

(12) United States Patent
McVeen

(10) Patent No.: US 9,526,997 B2
(45) Date of Patent: Dec. 27, 2016

(54) VEHICLE TRANSPORTATION ROOM SYSTEM AND METHOD

(71) Applicant: Universal City Studios LLC, Universal City, CA (US)

(72) Inventor: Keith Michael McVeen, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 120 days.

(21) Appl. No.: 14/337,220

(22) Filed: Jul. 22, 2014

(65) Prior Publication Data

US 2016/0023121 A1 Jan. 28, 2016

(51) Int. Cl.
*A63G 31/16* (2006.01)
*A63G 7/00* (2006.01)

(52) U.S. Cl.
CPC ..... *A63G 31/16* (2013.01); *A63G 7/00* (2013.01)

(58) Field of Classification Search
CPC ..... A63G 7/00; A63G 31/00; A63G 31/02; A63G 31/04; A63G 31/06; A63G 31/16
USPC ..... 104/53, 83–86
See application file for complete search history.

(56) References Cited

U.S. PATENT DOCUMENTS

| | | | |
|---|---|---|---|
| 4,251,140 | A | 2/1981 | Fogerty, Jr. |
| 4,752,065 | A | 6/1988 | Trumbull et al. |
| 4,879,849 | A | 11/1989 | Hollingsworth, III et al. |
| 5,473,990 | A | 12/1995 | Anderson et al. |
| 5,857,917 | A | 1/1999 | Francis et al. |
| 5,865,624 | A | 2/1999 | Hayashigawa |
| 6,079,982 | A | 6/2000 | Meader |
| 6,095,926 | A | 8/2000 | Hettema et al. |
| 6,113,500 | A | 9/2000 | Francis et al. |
| 6,397,755 | B1 | 6/2002 | Kamler |
| 6,462,769 | B1 | 10/2002 | Trowbridge et al. |
| 6,533,670 | B1 | 3/2003 | Drobnis |
| 8,035,682 | B2 | 10/2011 | Trowbridge |
| 8,137,205 | B2 | 3/2012 | Cortelyou et al. |
| 8,179,337 | B2 | 5/2012 | Wilzbach et al. |
| 2003/0203759 | A1 | 10/2003 | Begotti |

(Continued)

FOREIGN PATENT DOCUMENTS

| | | | |
|---|---|---|---|
| AU | 199640821 | A | 11/1996 |
| CN | 101428182 | A | 5/2009 |

(Continued)

OTHER PUBLICATIONS

PCT/US2015/039434 PCT International Search Report and Written Opinion dated Oct. 22, 2015.

*Primary Examiner* — Robert McCarry, Jr.
(74) *Attorney, Agent, or Firm* — Fletcher Yoder, P.C.

(57) ABSTRACT

A vehicle transportation room system and method are disclosed. In one embodiment, a system may include a ride vehicle disposed on a ride path and a launch room vehicle may be configured to align with the ride vehicle on the ride path and include an at least partial room. The launch room vehicle may be configured to house the ride vehicle in the at least partial room and to move with the ride vehicle and then break coordination with the ride vehicle such that the ride vehicle launches from the at least partial room. Further, the launch room vehicle may include a show element that is operated as the at least partial room moves with the ride vehicle to simulate that the show element is interacting with the ride vehicle.

22 Claims, 10 Drawing Sheets

(56) References Cited

U.S. PATENT DOCUMENTS

| | | | |
|---|---|---|---|
| 2007/0009861 | A1 | 1/2007 | Heinrich |
| 2009/0084285 | A1 | 4/2009 | Verl et al. |
| 2010/0207083 | A1 | 8/2010 | Roodenburg et al. |

FOREIGN PATENT DOCUMENTS

| | | | | | |
|---|---|---|---|---|---|
| DE | 10049681 | A | | 4/2002 | |
| FR | 2677155 | A1 | | 12/1992 | |
| JP | 11219101 | | | 8/1999 | |
| JP | 2004097243 | A | | 4/2004 | |
| NL | 1009494 | | * | 1/2000 | ..... A63G 31/16 |
| WO | 2013091886 | A1 | | 6/2013 | |

* cited by examiner

VEHICLE TRANSPORTATION ROOM SYSTEM AND METHOD

BACKGROUND

The present disclosure relates generally to the field of amusement parks. More specifically, embodiments of the present disclosure relate to vehicles and methods used in conjunction with amusement park rides.

Amusement parks (or theme parks) often include ride attractions with vehicles that may accommodate one or more patrons. In some instances, the vehicles may be disposed on a track and driven around a fixed course, or the vehicles may be self-propelled and configured to navigate through an open course. The vehicles may be launched and/or manually moved at various portions ("motivating portions") of the ride attraction to enhance the excitement experienced by the patrons. However, some ride attractions' motivating portions may only include increasing the speed of the vehicles or pulling the ride vehicles up a hill in the track or course. With the increasing sophistication and complexity of modern ride attractions, and the corresponding increase in expectations among amusement or theme park patrons, improved and more creative motivating portions are needed.

BRIEF DESCRIPTION

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In accordance with one aspect of the present disclosure, a system may include a ride vehicle disposed on a ride path and a launch room vehicle that may be configured to align with the ride vehicle on the ride path and including an at least partial room. The launch room vehicle may be configured to house the ride vehicle in the at least partial room and to move with the ride vehicle and then break coordination with the ride vehicle such that the ride vehicle launches from the at least partial room.

In accordance with another aspect of the present disclosure, a system may include a ride vehicle disposed on a first ride path and a launch room vehicle disposed on a second ride path. The launch room vehicle may include a left side wall, right side wall, back wall, and a ceiling, where the left side wall, right side wall, and back wall may each be connected to the ceiling to form a partial room that includes a show element. The partial room may be configured to house the ride vehicle. The show element may be configured to operate synchronously with the movement of the launch room vehicle and the ride vehicle, and the launch room vehicle may be configured to move with and propel the ride vehicle and to be break contact from the ride vehicle such that the ride vehicle launches from the partial room.

In accordance with another aspect of the present disclosure, a method may include driving a ride vehicle disposed on a first ride path via an initial path into a partial room of a launch room vehicle disposed on a second ride path, parking the ride vehicle in the partial room, operating one or more show elements included in the partial room, switching the configuration of the first ride path to follow a different path than the initial path, propelling the ride vehicle via the launch room vehicle on the different path and operating the one or more show elements synchronously with the movement of the launch room vehicle, and breaking contact between the launch room vehicle and the ride vehicle such that the ride vehicle launches from the partial room.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Presently disclosed embodiments are directed to utilizing a launch room vehicle or launching mechanism to propel a ride vehicle and the launch room vehicle along a motivating portion of a ride attraction in an amusement or theme park. The launch room vehicle or launching mechanism may include a partially enclosed room configured to house a ride vehicle. The ride vehicle may be driven into the partial room and parked. The launch room vehicle may include one or more show elements, such as displays, animatronic characters, speakers, fog machines, strobe lights, or the like configured to operate in sync with each other and the movement of the launch room vehicle and/or the ride vehicle. Additionally, the ride vehicles may include one or more show elements. In particular, during operation, the show elements may create an impression among the patrons that the ride vehicle is being pushed and/or pulled by an entity presented in the partial room. The entity may be simulated by coordinating operation of one or more of the show elements. For example, the animatronic character may represent a monster, wizard, or other entity that appears to cast a spell upon the ride vehicle. In addition, the displays may show effects, such as lightning, electricity, smoke, or the like, and the speakers may project noises to help conjure up the reality of the entity casting the spell. Meanwhile, the launch room vehicle may be moving with the ride vehicle and slowly ramping up the ride vehicle's speed simultaneously as the intensity of the effects simulating the entity casting the spell increases. In other embodiments, different effects may be employed, such as weather simulation, earthquakes, and so forth.

At some point, another entity may be presented in the partial room by utilizing the show elements. A finale of effects produced by the show elements may cause the second entity to interrupt the first entity's spell and trigger the ride vehicle to break contact with and launch from the launch room vehicle. In this way, the patrons may experience an exciting show during the motivating portion that enhances the launch experience and likeability of the ride attraction. By employing the launch room vehicle and its show elements in conjunction with particular themes, such as traditional movies or video games, guests are incentivized to visit the amusement park and are further enabled to enjoy the thematic and/or theatrical experience provided by the amusement park.

Figure 1:
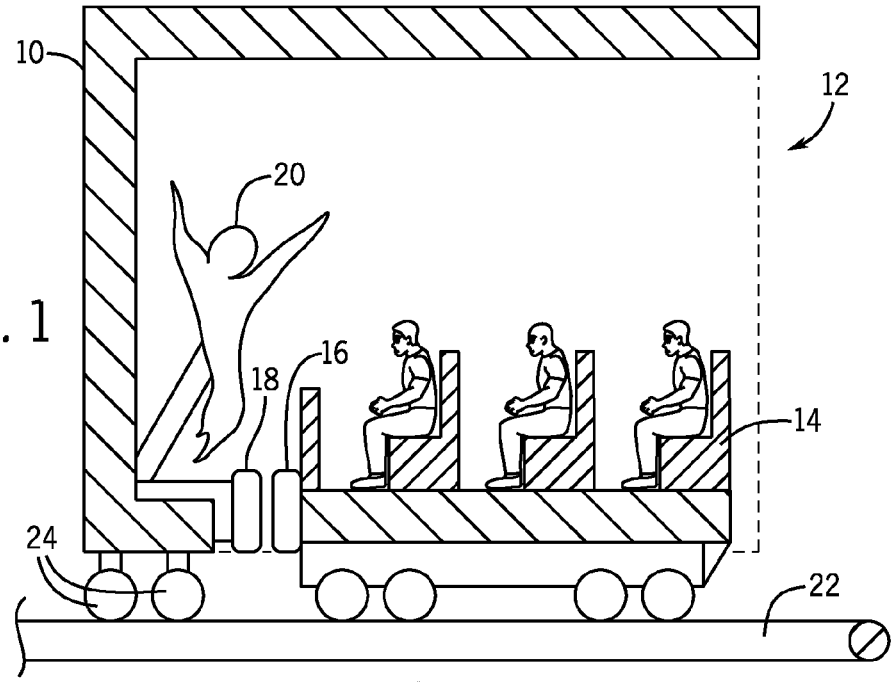
FIG. 1 illustrates a schematic side view of launch room vehicle including a partial room housing a ride vehicle, in accordance with an embodiment.

With the foregoing in mind, FIG. 1 illustrates an embodiment of a launch room vehicle 10 including a partial room 12 housing a ride vehicle 14, in accordance with the present disclosure. A section of the launch room vehicle 10 may be "U" shaped in that the partial room 12 includes two side walls, a back wall, and a ceiling, with one end being open so that the ride vehicle 14 may enter and exit the partial room 12. When the ride vehicle 14 enters the partial room 12, the ride vehicle 14 or the ride path may apply a braking system causing the ride vehicle 14 to park. Further, a bumper 16 installed on the ride vehicle 14 may contact a bumper 18 installed on one or more walls of the launch room vehicle 10. The bumpers 16, 18 may remain in contact with one another while the launch room vehicle 10 pushes the ride vehicle 14 to a desired speed and/or point on a ride path 22. Additionally or alternatively, the bumpers 16, 18 may interlock so that the launch room vehicle 10 may pull the ride vehicle 14 to a desired speed and/or point on the ride path 22. Also, the launch room vehicle 10 may include one or more wheels 24 configured to traverse the ride path 22.

The ride path 22 may include a track (e.g., roller coaster track), an open floor course, water chutes, or some combination thereof. In some embodiments, the ride path 22 may include a first track on which the ride vehicle 14 is disposed and a second track on which the launch room vehicle 10 is disposed. The second track may align with the first track. For example, the second track may be located above the first track so that the launch room vehicle 10 is hanging. In some embodiments, the launch room vehicle 10 may be lifted away after the ride vehicle 14 breaks contact from the launch room vehicle 10 or the launch room vehicle 10 may continue on a straight path if the ride vehicle 14 drops out of the launch room vehicle 10 on a descending hill. In another embodiment, the second track may be next to and substantially parallel with the first track. However, in yet another embodiment, the launch room vehicle 10 and the ride vehicle 14 may be disposed upon and share the same track. In the depicted embodiment, the ride vehicle 14 is parked facing the back wall of the partial room 12 on the same track. Thus, the launch room vehicle 10 may push the ride vehicle 14 backwards when it begins the launching sequence. However, as will be described below, there are embodiments where the ride vehicle 14 may be pushed or pulled while it is facing forward.

In addition, as mentioned above, the launch room vehicle 10 may include one or more show elements 20, such as an animatronic character, display screen, speaker, fog machine, strobe light, or the like. Accordingly, the launch room vehicle 10 may include circuitry to control the show elements 20. The circuitry may include one or more processors to execute computer-executable code stored on one or more memories. The processors may be included in one or more automation controls (e.g., programmable logic controller (PLC)) that is connected to and controls the operation of the various show elements 20. For example, the circuitry may control the movement of the animatronic character, the images or videos displayed on the display screens, the audio played from the speakers, and so forth. Further, the circuitry may control or at least coordinate with movement of the ride vehicle 14.

The one or more memories may also store video, image, and/or audio data that is played during the launching sequence. Indeed, the circuitry may control the show elements 20 in sync with the movement of the launch room vehicle 10 to provide a theatrical experience as the launch room vehicle 10 moves with the ride vehicle 14. That is, the coordinated show elements 20 may create an impression that the entity (e.g., animatronic character, display screens, speakers) is pushing and/or pulling patrons within the ride vehicle 14 because the entity inside the partial room 12 of the launch room vehicle 10 moves with the launch room vehicle 10 as it motivates the ride vehicle 14 to the desired speed and/or point on the ride path 22. Because the surroundings (the partial room 12) move with the ride vehicle 14, patrons in the ride vehicle will feel physical effects disassociated with their cause. Additionally, the launch room vehicle 10 may be configured to tilt utilizing a hydraulic lift system to enhance the impression that there is a force pushing or pulling the patrons toward or away from the entity.

Likewise, the ride vehicle 14 may include one or more show elements, such as an animatronic character, display screen, speaker, fog machine, strobe light, or the like. Accordingly, the ride vehicle 14 may include circuitry to control the show elements. The circuitry may include one or more processors to execute computer-executable code stored on one or more memories. The processors may be included in one or more automation controls (e.g., programmable logic controller (PLC)) that is connected to and controls the operation of the various show elements. For example, the circuitry may control the movement of the animatronic character, the images or videos displayed on the display screens, the audio played from the speakers, and so forth. The memories may also store video, image, and/or audio data that is played during the launching sequence. Indeed, the circuitry may control the show elements in sync with each other and the movement of the launch room vehicle 10 and/or the ride vehicle 14 to provide a theatrical experience as the ride vehicle 14 is propelled by the launch room vehicle 10. The show elements of the ride vehicle 14 may operate in coordination with the show elements of the launch room vehicle 10 to create an impression that the entity (e.g., animatronic character, display screens, speakers) is pushing or pulling the ride vehicle 14.

Figure 2:
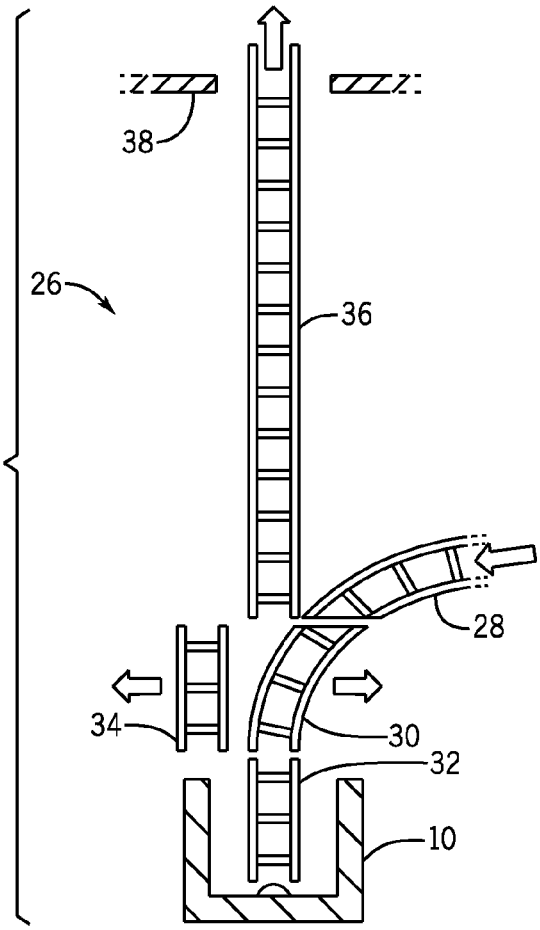
FIG. 2 illustrates a schematic overhead view of a motivating portion of a ride attraction path upon which the launch room vehicle may be disposed, in accordance with an embodiment.

An embodiment of a motivating portion 26 of a ride attraction path that may include the launch room vehicle 10, as described above, is illustrated in FIG. 2. In the depicted embodiment, the motivating portion 26 of the ride path includes tracks such as those utilized in roller coaster rides. The motivating portion 26 may include an entrance track 28, a curved transfer track 30, a dead-end track 32, a straight transfer track 34, a launch track 36, a stopping point 38 for the launch room vehicle 10, or some combination thereof. The stopping point 38 may include one or more stoppers (e.g., barrier wall, rubber stopper) that stops the launch room vehicle 10, one or more sensors that the launch room vehicle 10 may pass through to trigger the launch room vehicle 10 to stop, or the like. The launching sequence is described in further detail with reference to FIGS. 3A-3D.

Figure 3A:
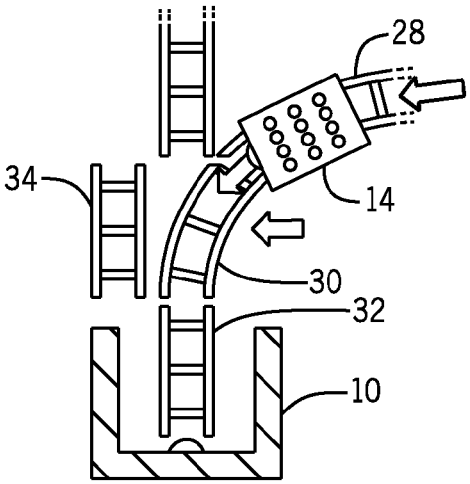
FIGS. 3A-3D illustrate schematic overhead representations of a sequence of events for utilizing the launch room vehicle to motivate the ride vehicle, in accordance with an embodiment.
Figure 3B:
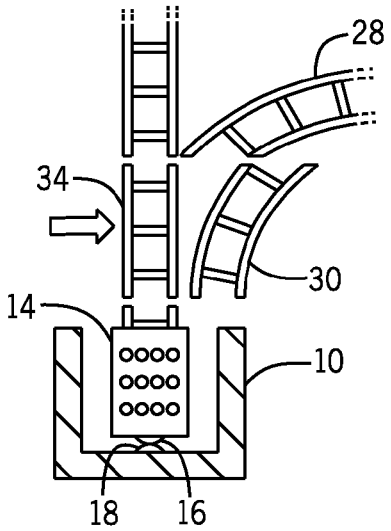
Figure 3C:
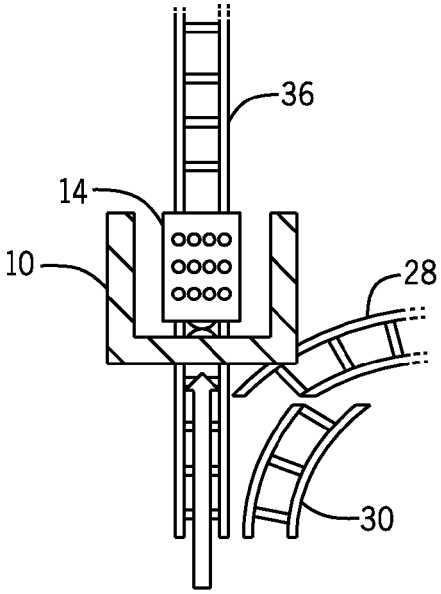

The launching sequence may begin as shown in FIG. 3A where a ride vehicle 14 carrying one or more passengers approaches the launch room vehicle 10 via the entrance track 28, which may be curved. The ride vehicle 14 may traverse the curved transfer track 30 and drive onto the dead-end track 32, as shown in FIG. 3B, where the ride vehicle 14 or the track may utilize a braking system that causes the ride vehicle 14 to stop and park. When the launching sequence begins, the show elements included in the launch room vehicle 10 and/or the ride vehicle 14 may begin operation. Meanwhile, the straight transfer track 34 may be switched with the curved transfer track 30 and aligned with the dead-end track 32 and the launch track 36. In some embodiments, a track switch may be utilized to switch from the curved configuration to the straight configuration. Once the straight transfer track 34 is in place, the launch room vehicle 10 may begin propelling the ride vehicle 14 backwards, as shown in FIG. 3C. It should be understood that in some embodiments, the ride vehicle 14 may enter the launch room vehicle 10 backwards and be propelled facing forward on the launch track 36 by the launch room vehicle 10. During propulsion, the launch room vehicle 10 may begin accelerating and its bumper 18 may contact the bumper 16 of the ride vehicle 14, thereby causing the ride vehicle 14 to move.

Figure 3D:
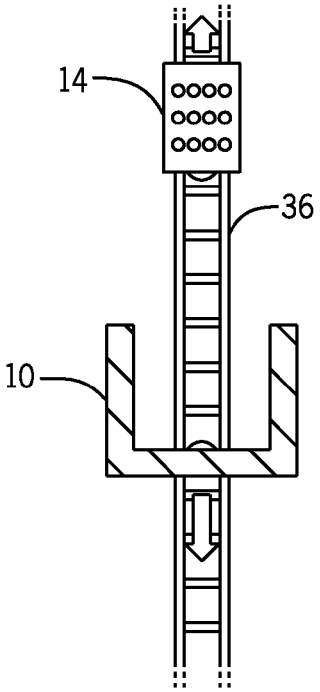

As the ride vehicle 14 is being motivated, the show elements 20 may be operating in sync with the movement of the launch room vehicle 10 to create an impression (e.g., simulate) that an entity is pushing or pulling the ride vehicle 14. For example, an animatronic character, such as a monster, wizard, or the like, may appear to be physically rocking or casting a spell on the ride vehicle 14 that is causing the ride vehicle to be pushed or pulled. At the same time, the other show elements may be operating synchronously with the animatronic character and the movement of the launch room vehicle 10 to enhance the illusion. That is, the displays may show effects (e.g., smoke, sparks, lightning), a fog machine may generate fog, and the speakers may project audio. One or more of the show elements may change operation at the launching point of the ride vehicle 14 to produce a finale of effects. For example, the display may show a wizard dispelling the monster or other wizard. In conjunction, the show elements may distract the patrons from realizing that the ride vehicle 14 has reached a certain speed so that when the ride vehicle 14 disengages from the launch room vehicle 10 and the show elements operate in theatrical coordination, the patrons may experience and feel an explosive launch. As depicted in FIG. 3D, after the ride vehicle 14 disembarks from the launch room vehicle 10, the ride vehicle 14 may continue down the ride path and the launch room vehicle 10 may stop and reverse directions on the launch track 36 to reset for the next ride vehicle 14.

In an embodiment, the motivating portion 26 of the ride attraction path may include separately aligned straight tracks that the launch room vehicle 10 and the ride vehicle 14 are disposed on. In this embodiment, the ride vehicle 14 may enter the launch room vehicle 10 on the straight track and park facing the back wall of the partial room 12. Then, the launch room vehicle 10 and the ride vehicle 14 may interlock bumpers 16, 18 (e.g., engage underneath or around each other) and the launch room vehicle 10 may pull the ride vehicle 14 forward. As the launch room vehicle 10 increases the speed of the ride vehicle 14, the show elements of the launch room vehicle 10 and/or the ride vehicle 14 may be operated in such a way as to simulate that an entity (e.g., combination of animatronic character, display, speakers) is pulling the ride vehicle 14 towards the entity (e.g., by casting a spell). At a desired speed and/or point on the track, the launch room vehicle 10 and the ride vehicle 14 may disconnect and the ride vehicle 14 may be launched facing forward. Techniques and configurations of motivating portions of ride paths for launching a forward facing ride vehicle 14 are discussed in more detail below.

Figure 4:
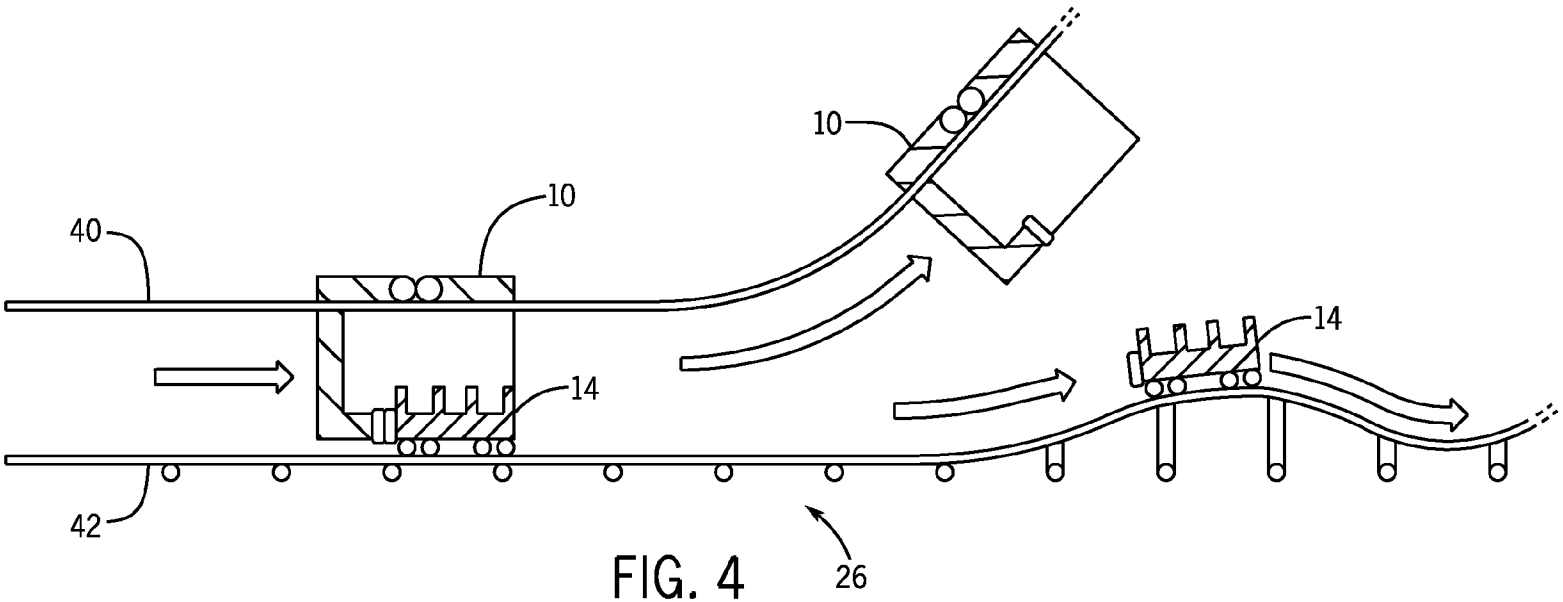
FIG. 4 illustrates a schematic side view of a motivating portion of a ride attraction path utilized to propel a ride vehicle backwards where the launch room vehicle is hanging from a path above the ride vehicle's path, in accordance with an embodiment.

As discussed above, when launching the ride vehicle 14 backwards, the launch room vehicle 10 may share the same ride path as the ride vehicle 14 or the two vehicles 10 and 14 may be on different paths. For example, FIG. 4 illustrates a motivating portion 26 of a ride attraction path utilized to propel a ride vehicle 14 backwards where the launch room vehicle 10 is hanging from a path 40 separate from and above the ride vehicle's path 42. In some embodiments, the launch room vehicle path 40 and the ride vehicle path 42 may include tracks utilized in roller coasters. As depicted, the launch room vehicle 10 may continue along its path 40 that inclines up and away from the ride vehicle path 42 after the ride vehicle 14 is launched. The launch room vehicle 10 may remain out of the way until the ride vehicle 14 has passed a certain point on its path 42, such as the crest of a hill. After the ride vehicle 14 has passed the point on its path 42, the launch room vehicle 10 may reverse directions on its path 40 and reset for the next ride vehicle 14. In another embodiment, the launch room vehicle path 40 may end and the launch room vehicle 10 may be stopped as the ride vehicle 10 is launched. In this embodiment, a wall or stoppers at the end of the path 40 may cause the launch room vehicle 10 from continuing with the ride vehicle 14. Further, in some embodiments, the ride vehicle path 42 may decline and the ride vehicle 14 may drop out of the launch room vehicle 10 while the launch room vehicle 10 continues at the same level on its path 40 until stopped.

Figure 5:
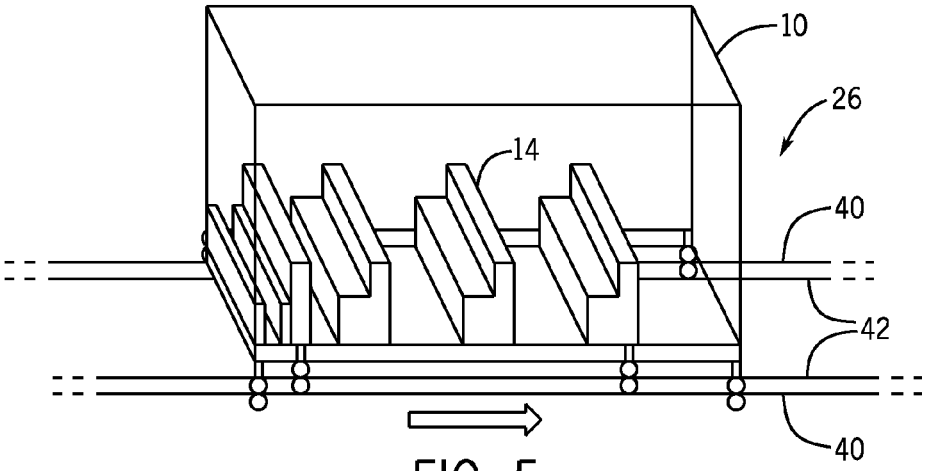
FIG. 5 illustrates a simplified perspective view of a motivating portion of a ride attraction path utilized to propel a ride vehicle backwards where the launch room vehicle is disposed on an outer path substantially parallel to the ride vehicle's inner path, in accordance with an embodiment.

Additionally, and as mentioned above, in another embodiment a launch room vehicle path 40 may be adjacent and substantially parallel to a ride vehicle path 42. For example, FIG. 5 illustrates a motivating portion 26 of a ride attraction path utilized to propel a ride vehicle 14 backward where the launch room vehicle 10 is disposed on the path 40 separate from and adjacent to the ride vehicle's path 42. In this embodiment, the parallel paths 40 and 42 may also include tracks such as those utilized in roller coasters. Further, the stopping point for the launch room vehicle 10 may include a wall that only extends far enough so that the launch room vehicle 10 contacts it, or the launch room vehicle path 40 may end, and the end of the path 40 may include stoppers that prevent the launch room vehicle 10 from continuing with the ride vehicle 14. In some embodiments, the launch room vehicle path 40 may incline and the launch room vehicle 10 may climb up a hill and away from the ride vehicle path 42 after the ride vehicle 14 disengages from the launch room vehicle 10. In another embodiment, the ride vehicle path 42 may decline and the ride vehicle 14 may drop out of the launch room vehicle 10 at a certain point while the launch room vehicle 10 continues straight at the same level on its path 40 until stopped. It should be noted that, in some embodiments, the launch room vehicle 10 does not drive the ride vehicle 14 but both are moved in sync by other ride elements.

Figure 6:
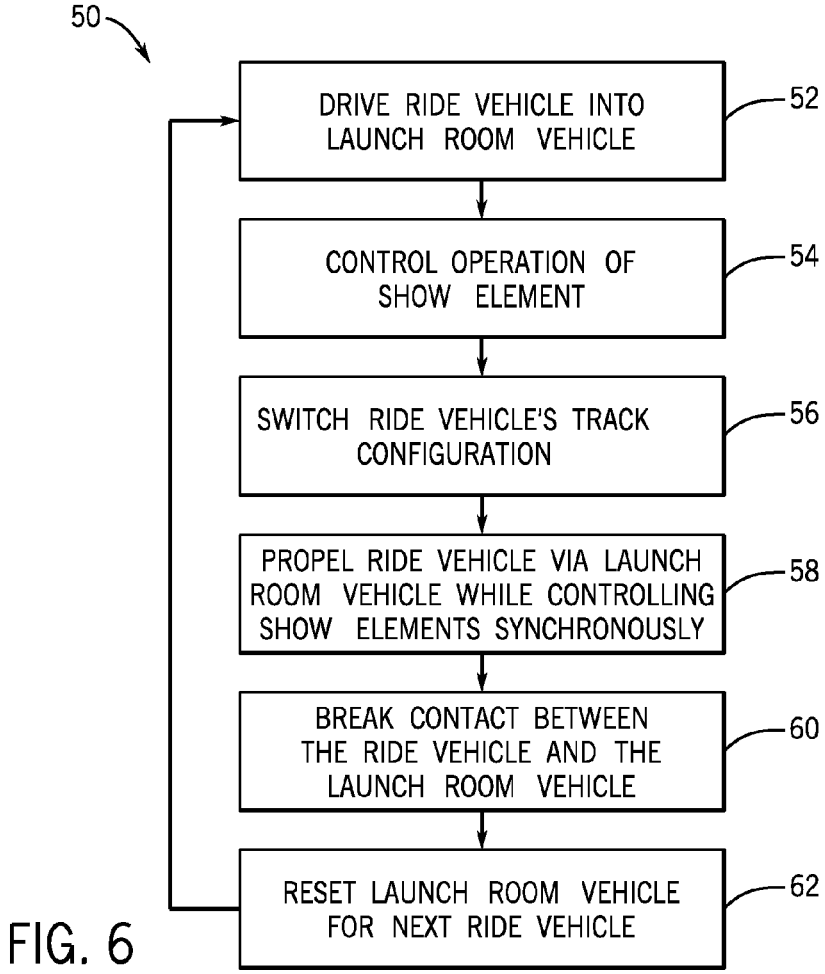
FIG. 6 is a flow diagram of a process for utilizing the launch room vehicle to propel the ride vehicle at a motivating portion of a ride attraction path, in accordance with an embodiment.

A flow diagram of a process 50 for utilizing the launch room vehicle to propel the ride vehicle backwards at a motivating portion of a ride attraction path, in accordance with an embodiment, is shown in FIG. 6. The process 50 may include driving a ride vehicle into a launch room vehicle (process block 52), controlling operation of show elements in the launch room vehicle and/or the ride vehicle (process block 54), switching the configuration of the ride vehicle's path (process block 56), propelling the ride vehicle via the launch room vehicle while synchronously controlling the show elements (process block 58), breaking contact between the ride vehicle and the launch room vehicle at a desired point and/or speed (process block 60), and resetting the launch room vehicle for the next ride vehicle (process block 62). Certain portions of the process 50 may be implemented as computer-executable code stored on one or more non-transitory, computer-readable mediums executed by one or more processors, such as a PLC.

To elaborate, the process 50 may begin at process block 52 by driving the ride vehicle over the curved transfer track into the partial room of the launch room vehicle. However, as discussed below, in some embodiments, the ride vehicle may not traverse a transfer track and may remain on a single ride path. For example, the ride vehicle may drive into the launch room vehicle and the launch room vehicle may engage the ride vehicle and pull the ride vehicle for a forward facing launch. In another embodiment, a launching mechanism may be attached to an arm or a turn table that rotates in a circle and the launching mechanism may rotate behind the ride vehicle to partially encapsulate it and launch it around a half circular bend.

Returning to the embodiment where the ride vehicle enters the launch room vehicle via the transfer track, once inside the partial room, the ride vehicle may be stopped and parked by utilizing a braking system, linear induction motors, linear synchronous motors, or the like. Or the ride vehicle may come to a rest after contacting bumpers with the launch room vehicle. In this way, the launch room vehicle may catch the ride vehicle in its partial room. The ride vehicle may remain parked in the partial room as the show elements operation is initiated by the launch room vehicle circuitry and/or ride vehicle circuitry in process block 54. This may entail operating one or more animatronic characters, displaying stored media on the display devices, projecting associated audio via the speakers, generating fog via the fog machine, flashing lights via the strobe light, and so forth inside of the partial room. While the show elements are controlled in coordination to create a desired theatrical or thematic experience, the configuration of the ride vehicle's path may be switched (process block 56). As discussed above, this may include utilizing a track switch to switch the path from a curved configuration to align in a straight configuration with a launch track and the dead-end track on which the ride vehicle is parked. In some embodiments, the curved transfer track may be physically shifted and a straight transfer track may replace it to align with the launch track and the dead-end track.

Once the configuration of the track has been switched, the launch room vehicle may propel the ride vehicle while controlling the operation of the show elements synchronously with the movement of the launch room vehicle and/or the ride vehicle (process block 58). For example, certain media may be set to display and certain actions may be performed by the animatronic character at specific points on the track and/or at determined speeds of the launch room vehicle. Thus, the effects produced by the show elements may be coordinated to build up in intensity as the speed of the launch room vehicle increases to provide an exciting launch. In one embodiment, a triggering event may occur right before or at the time the ride vehicle breaks contact from the launch room vehicle (process block 60). An example of such a triggering event may be an entity (e.g., wizard) disrupting the animatronic character's spell casting and releasing the ride vehicle from his apparent spell. At that point, the show elements may be coordinated in a finale of effects and the ride vehicle may be rapidly accelerated to provide an explosive launch for the patrons in the ride vehicle. It should be noted that the launch room vehicle may propel the ride vehicle by accelerating and pushing one or more of its bumpers against one or more bumpers of the ride vehicle. That is, in some embodiments, the launch room vehicle and the ride vehicle may not be latched to one another.

After the ride vehicle is disengaged from the launch room vehicle, the launch room vehicle may reverse directions to reset for the next ride vehicle (process block 62). In addition, once the launch room vehicle has returned to its starting place, the track configuration may be switched to enable the ride vehicle to enter the launch room vehicle via the curved transfer track, and the process 50 may restart by returning to process block 52.

Figure 7A:
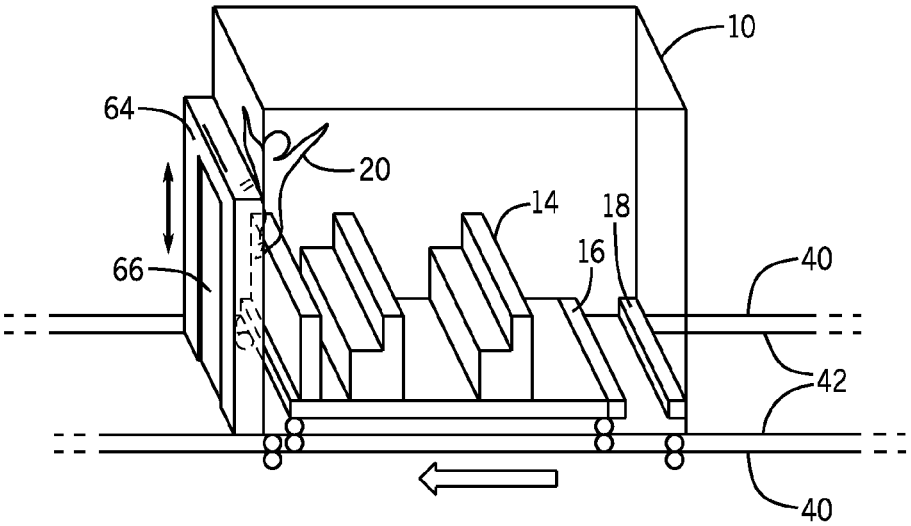
FIGS. 7A and 7B illustrate simplified perspective views of a launch room vehicle including a fireplace utilizing a retractable wall to propel a forward facing ride vehicle, in accordance with an embodiment.
Figure 7B:
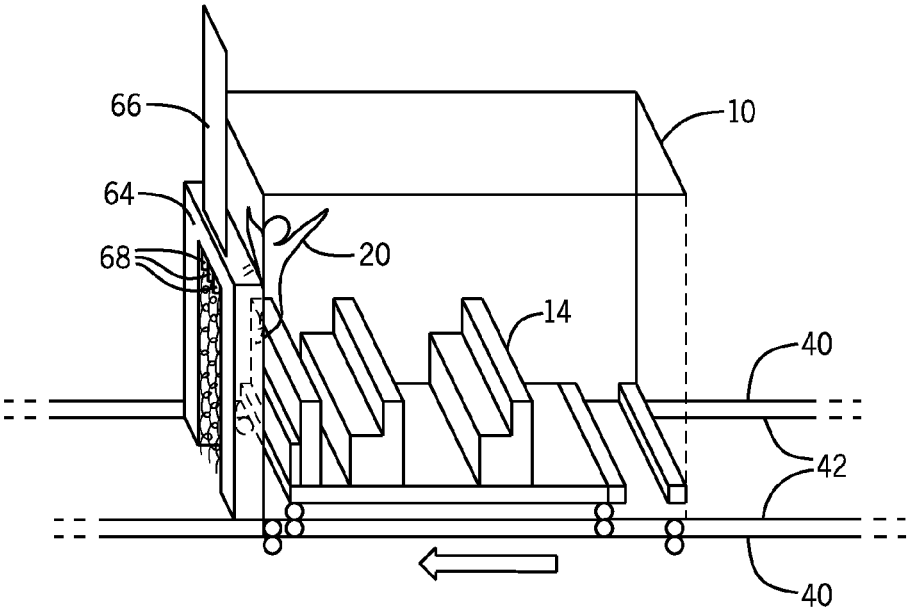

In another embodiment, FIGS. 7A and 7B illustrate a launch room vehicle 10 including a fireplace 64 utilizing a retractable wall 66 to propel a ride vehicle 14 facing forward. In this embodiment, all four sides of the launch room vehicle 10 may be enclosed at specific points along the ride path. For example, the retractable wall 66 may be raised or slid out of the way when the ride vehicle 14 enters the launch room vehicle 10. Then, the retractable wall 66 may be lowered at the beginning of a launching sequence and the patrons may be looking forward at the fireplace 64, as shown in FIG. 7A. The fireplace 64 may include one or more show elements 20 such as a display screen, fog machine, and the like, the launch room vehicle 10 may include other show elements 20, such as animatronic characters, display devices, speakers, and the like, and/or the ride vehicle 14 may include show elements 20, such as animatronic characters, display devices, speakers, and so forth.

When the launch sequence initializes, the launch room vehicle and/or ride vehicle circuitry may control the operation of the various show elements 20. In one embodiment, the animatronic character of the launch room vehicle may be operated to appear as if the character is casting a spell upon the ride vehicle 14. Other show elements 20 within the launch room vehicle 10, the ride vehicle 14, and/or the fireplace 64 may be controlled synchronously as the launch room vehicle 10 begins to push the ride vehicle 14 forward by contacting bumpers 16, 18. As mentioned above, the show elements 20 may be coordinated to provide a theatrical or thematic experience that increases in intensity as the launch room vehicle's speed increases and may finish in a finale of effects when the ride vehicle 14 is launched to provide an explosive experience for the patrons. As depicted in the embodiment, the launch room vehicle 10 may be disposed upon its own path 40 and the ride vehicle 14 may be disposed upon its own path 42. As the launch room vehicle 10 increases speed, fog or smoke may be generated from various vents 68 in the fireplace 64 to create a smokescreen that inhibits the ride vehicle patrons from seeing the retractable wall 66. Once the smokescreen is in place, the retractable wall 66 may be raised or moved out of the way so that the ride vehicle 14 may be released from the launch room vehicle 10 at the desired time, as shown in FIG. 7B. When a triggering event or finale of effects occurs and the ride vehicle 14 is released, the ride vehicle 14 may accelerate rapidly through the smokescreen out of the launch room vehicle 10. Then, the launch room vehicle 10 may stop and reverse directions to reset for the next ride vehicle 14.

Figure 8:
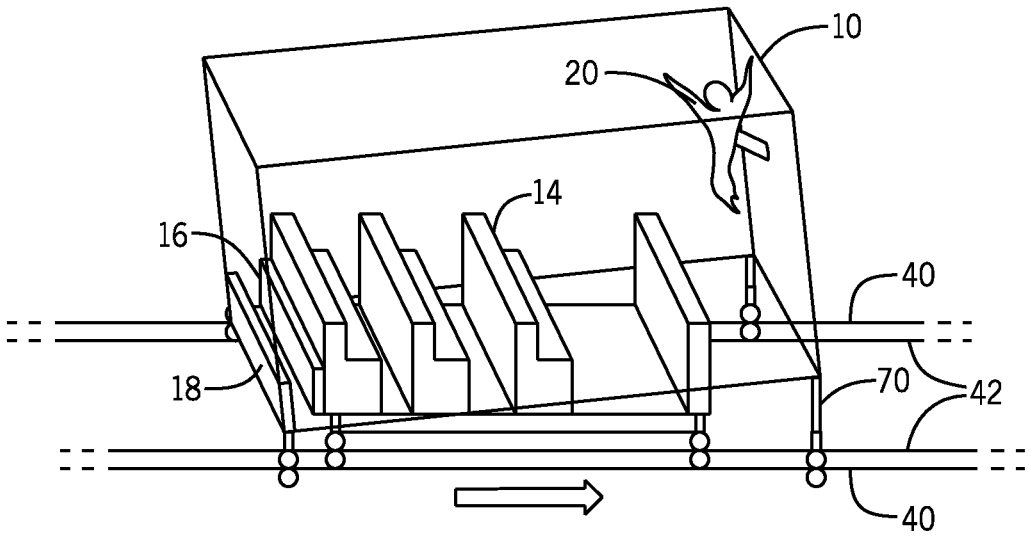
FIG. 8 illustrates a simplified perspective view of a launch room vehicle utilizing a hydraulic lift system to propel a forward facing ride vehicle, in accordance with an embodiment.

Further, FIG. 8 illustrates a launch room vehicle 10 utilizing a hydraulic lift system 70 in an embodiment configured to propel a ride vehicle 14 that is facing forward. In this embodiment, the launch room vehicle may include four walls that enclose the ride vehicle 14 when it is placed inside the launch room vehicle 10. The hydraulic lift system 70 may be of any suitable type, including electric, pneumatic, or the like. The ride vehicle 14 may enter the launch room vehicle 10 in reverse while the launch room vehicle is raised with the hydraulic lift system 70. Once the ride vehicle 14 has come to a rest and is parked within the launch room vehicle 10, the hydraulic lift system 70 may lower the launch room vehicle 10 to surround the ride vehicle 14. This embodiment may also include show elements 20 included in the launch room vehicle 10 and/or the ride vehicle 14, as discussed above, and the show elements 20 may be controlled to operate synchronously with the movement of the launch room vehicle 10 and/or the ride vehicle 14 via circuitry. When the launching sequence begins, the launch room vehicle 10 may utilize its bumper 18 to push the ride vehicle 14 via its bumper 16. As the launch room vehicle 10 approaches its stopping point, the hydraulic lift system 70 may be slowly raising the launch room vehicle's front end, which may enhance the effect of an animatronic character, or other show element, included in the launch room vehicle casting a spell that is pulling the ride vehicle 14 forward or the like. When the launch room vehicle 10 reaches its stopping point, the hydraulic lift system 70 may be fully extended and the launch room vehicle 10 may stop, causing the ride vehicle 14 to break contact and launch from the launch room vehicle 10. Then, the launch room vehicle 10 may reverse directions and reset at its starting point. In some embodiments, seats in the ride vehicle 14 may automatically move (e.g., tilt) in sync with raising the launch room vehicle 10 with the lift system 70.

In another embodiment, the hydraulic lift system 70 may be included in both the front and the rear of the launch room vehicle 10. This may enable the launch room vehicle 10 to be located along a straight portion of the ride vehicle's path (e.g., on a secondary path parallel to or above the ride vehicle's path) so that the ride vehicle can drive forward facing and stop under the launch room vehicle 10, which may be fully lifted by both hydraulic lift systems 70. Then, the launch room vehicle 10 may be lowered around the ride vehicle 14 using the hydraulic lift systems 70, and the launch room vehicle may commence the launching sequence by pushing the ride vehicle 14 and synchronously operating the show elements 20 and the hydraulic lift system 70 as desired until the ride vehicle 14 is dispensed facing forward.

Figure 9A:
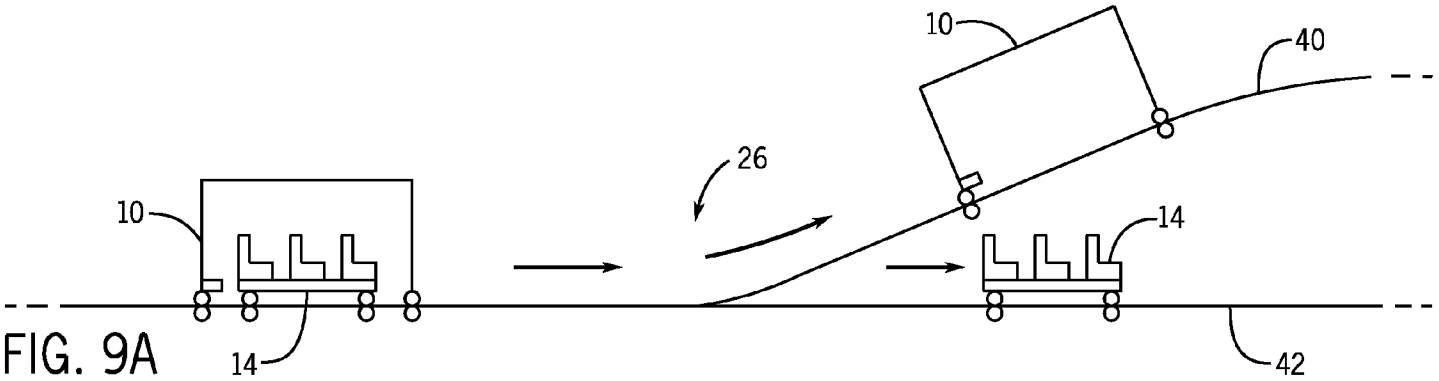
FIGS. 9A-9C illustrate schematic side views of configurations of motivating portions of ride attraction paths utilized to propel a forward facing ride vehicle where the launch room vehicle is hanging from a path above the ride vehicle's path, in accordance with an embodiment.
Figure 9B:
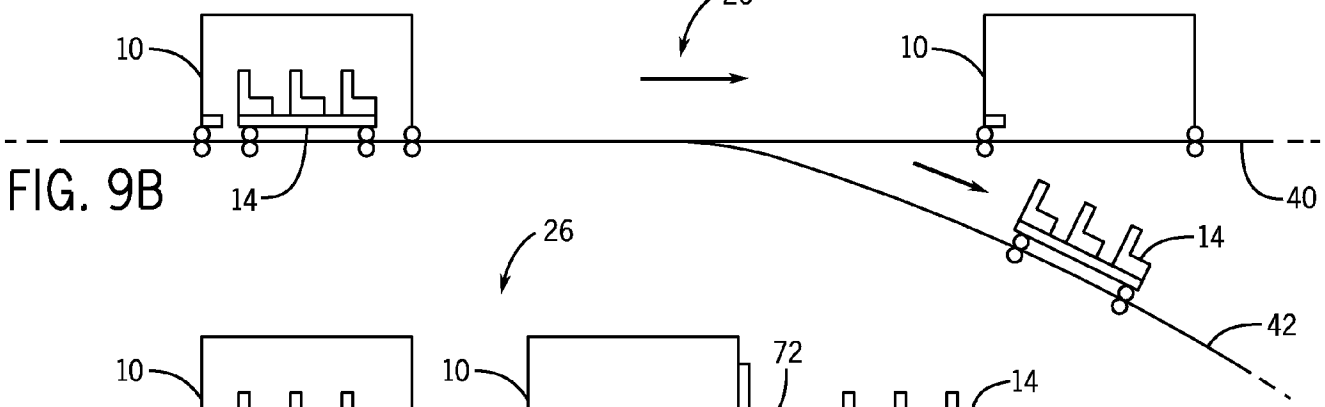
Figure 9C:
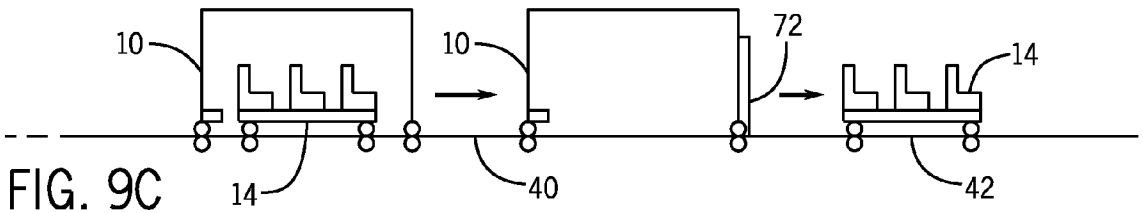
Figure 10A:
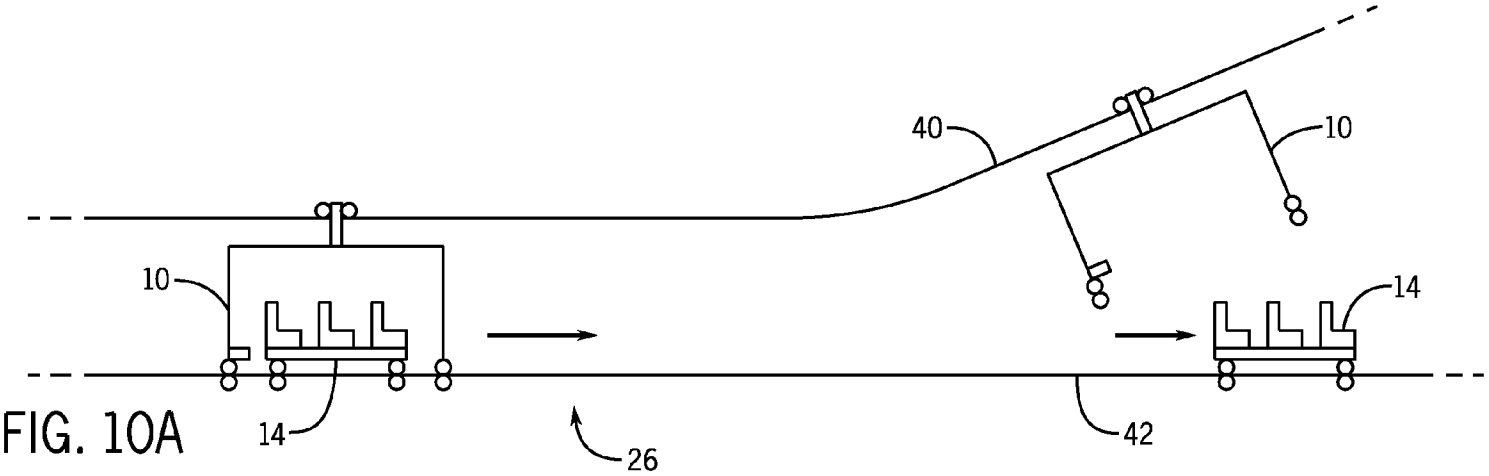
FIGS. 10A and 10B illustrate schematic side views of configurations of motivating portions of ride attraction paths utilized to propel a forward facing ride vehicle where the launch room vehicle is disposed on a path substantially parallel to the ride vehicle's path, in accordance with an embodiment.
Figure 10B:
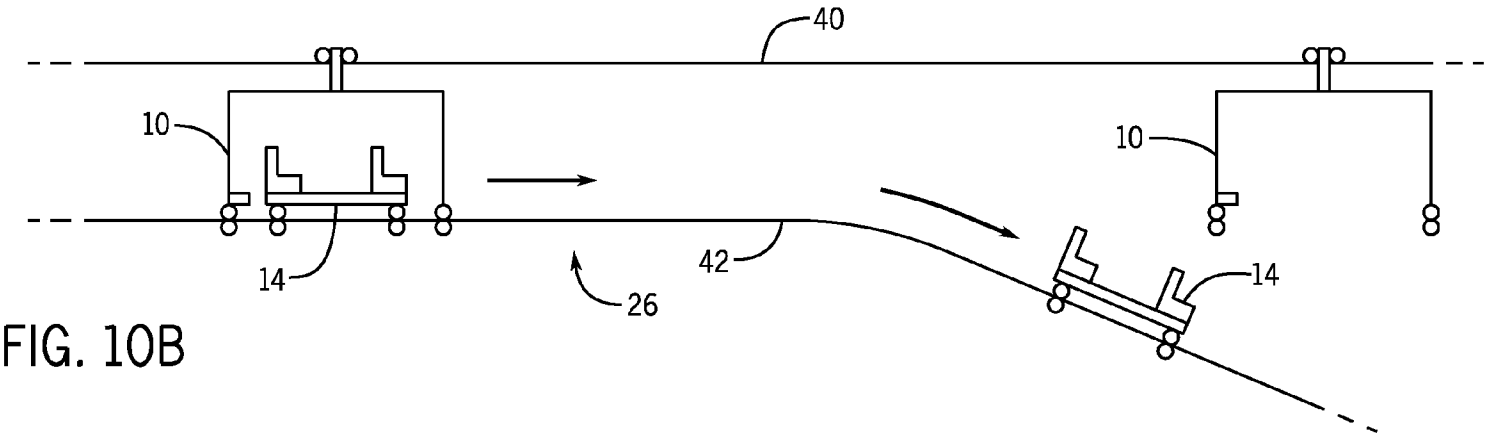

Embodiments of different motivating portions of ride path configurations utilized by a launch room vehicle 10 to propel a forward facing ride vehicle 14 are depicted in FIGS. 9A-9C and FIGS. 10A and 10B. FIGS. 9A-9C illustrate a motivating portion 26 where the launch room vehicle 10 is disposed upon a secondary ride path 40 that is adjacent and parallel to a ride vehicle path 42 until the ride vehicle 14 is launched. FIGS. 10A and 10B illustrate a motivating portion 26 where the launch room vehicle 10 is hanging from a secondary ride path 40 that is overhead of a ride vehicle path 42. It should be appreciated that for each of the embodiments illustrated in FIGS. 9A-9C and FIGS. 10A and 10B one or more of the techniques described above for launching a forward facing ride vehicle 14 out of the launch room vehicle 10 may be utilized, such as a partial room with an open wall, a fireplace including a retractable wall, and/or hydraulic lift system, among others. And, it is contemplated that the ride vehicle may be pushed or pulled depending on the design of the launch room vehicle 10, the ride vehicle 14, and/or the motivating path configuration.

Beginning with FIG. 9A, a motivating portion 26 of a ride attraction path is depicted where a launch room vehicle path 40 is parallel and aligned with a ride vehicle path 42 until a ride vehicle 14 disengages from a launch room vehicle 10 and then the launch room vehicle path 40 inclines as a hill. After the ride vehicle 14 is launched or disengaged from the launch room vehicle 10, the launch room vehicle 10 may continue on its path 40 that elevates above and out of the way of the ride vehicle 14. The launch room vehicle 10 may remain at the elevated position until the ride vehicle 14 has passed a desired point on the ride path, such as a crest on a hill or the like. At such time, the launch room vehicle 10 may return to its starting position.

FIG. 9B illustrates an embodiment of a motivating portion 26 of a ride attraction path where the launch room vehicle path 40 continues straight and the ride vehicle path 42 descends down a hill so the ride vehicle 14 may drop out of the launch room vehicle 10 as it is launched. When the launch room vehicle 10 has reached a certain point on its path 40, it may reverse directions and return to its starting point and reset for the next ride vehicle 14.

FIG. 9C illustrates an embodiment of a motivating portion 26 of a ride attraction path where the launch room vehicle path 40 terminates so that the launch room vehicle 10 is forced to stop and the ride vehicle 14 may be projected out of the launch room vehicle since it is on a separate inner path 42 than the launch room vehicle 10. In some embodiments, there may be stoppers 72 (e.g., walls, rubber stoppers) at the end of each rail of the launch room vehicle outer path 40 to catch the launch room vehicle 10.

FIGS. 10A and 10B illustrate embodiments of ride path configurations where the motivating portions 26 include the launch room vehicle path 40 being located overhead of the ride vehicle path 42 that may be utilized by a launch room vehicle 10 to propel a forward facing ride vehicle 14. Specifically, FIG. 10A illustrates a motivating portion 26 where the launch room vehicle path 40 lifts up and away from the ride vehicle path 42 at the point where the ride vehicle 14 disengages from the hanging launch room vehicle 10. Similarly to the discussion above for launching the ride vehicle 14 backwards, the launch room vehicle 10 may remain lifted out of the way on its path 40 until the ride vehicle 14 passes a certain point on its path 42, such as the crest of a hill or the like. Then, the launch room vehicle 10 may reset for the next ride vehicle 14. Further, in the illustrated embodiment in FIG. 10B, the motivating portion 26 includes the launch room vehicle path 40 continuing along a straight line and the ride vehicle path 42 descending down a hill to enable the ride vehicle 14 to drop out of the launch room vehicle 10 as desired. In this embodiment, a distance between passenger seating and the walls of the launch room vehicle 10 may be such that, in coordination with the drop along the path 40, contact between the passengers and wall cannot occur.

Figure 11:
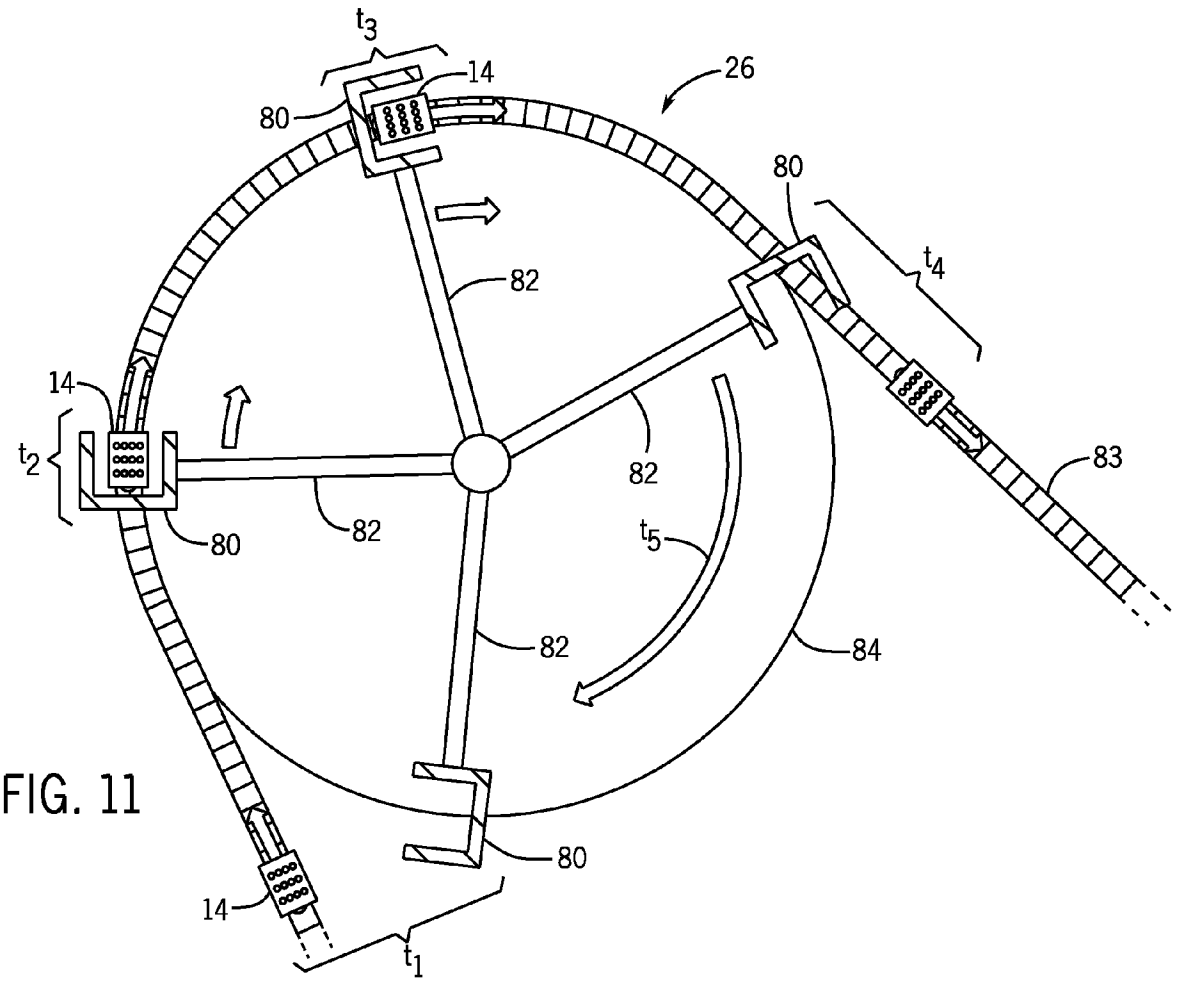
FIG. 11 illustrates a schematic overhead view of a launching mechanism attached to an arm or a turn table utilized to propel a ride vehicle at a motivating portion of a ride attraction path, in accordance with an embodiment.

In another embodiment, a launching mechanism 80 may be connected to an arm 82 that rotates in a circle to propel a ride vehicle 14 through a motivating portion 26 of a ride attraction path, as illustrated in FIG. 11. As depicted, the motivating portion 26 may include a half circular ride path that the ride vehicle 14 is disposed on that aligns with the launching mechanism 80 during part of its circular rotation. In some embodiments, the launching mechanism 80 may include a "U" shaped partial room (including three walls and a ceiling), a set piece, or an animatronic character. In embodiments where the launching mechanism 80 includes the partial room, various show elements may be installed inside of the partial room, such as an animatronic character, display devices, speakers, fog machines, strobe lights, among others. Similarly to the launching room vehicle described above, the animatronic character and other show elements of the launching mechanism 80 may be controlled in coordination with the movement of the launching mechanism 80 via circuitry included in the launching mechanism 80 to simulate that the show elements are pushing or pulling the ride vehicle 14.

As depicted, the ride vehicle 14 may approach the motivating portion 26 of the ride path and the launching mechanism 80 may be rotated behind the ride vehicle 14 into position by the arm 82 at an initial time (t1). The show elements may begin operation as the launching mechanism 80 approaches the ride vehicle 14 or when the launching mechanism 80 makes contact with the ride vehicle 14. At a second time (t2), the launching mechanism 80 may engage with the ride vehicle 14 by contacting bumper to bumper. The ride vehicle 14 may be facing forward or facing backward inside of the launching mechanism 80. Further, the launching mechanism 80 may be configured to align behind the ride vehicle 14 and push the ride vehicle 14 or the launching mechanism 80 may be reversed and configured to catch the ride vehicle 14 and pull the ride vehicle 14. In embodiments where the launching mechanism 80 catches the ride vehicle, the bumper on the launching mechanism 80 may be configured to engage underneath or around the bumper of the ride vehicle 14. In the depicted embodiment, the launching mechanism 80 rotates into position behind the ride vehicle 14 and, at a third time (t3), propels (e.g., pushes) the ride vehicle 80.

During this time (t3), the animatronic character or the show elements included in the partial room of the launching mechanism 80 may be operating to create the impression that the character is casting a spell to push the ride vehicle 14 as the launching mechanism 80 moves the ride vehicle 14. However, in embodiments where the launching mechanism 80 is configured to pull the ride vehicle 14, the coordinated show elements may generate the impression that the animatronic character is pulling the ride vehicle towards the character via the magic spell that it appears to be casting. As the speed of the launching mechanism 80 increases, the show elements may be controlled to produce more intense effects to build excitement until the point where the ride vehicle disengages at a fourth time (t4). During this time (t4), there may be a triggering event (e.g., a wizard appears and dispels the animatronic character) that acts as a finale to release the ride vehicle 14 so the ride vehicle 14 may be launched from the launching mechanism 80 to continue down its path and the launching mechanism 80 may continue around its circular path on the rotating arm 82. Then, at a fifth time (t5), the launching mechanism 80 may continue to rotate and reset for the next ride vehicle 14.

In some embodiments, the launching mechanism 80 may be attached to a turn table 84 instead of the rotating arm 82. However, the turn table 84 may function similarly to the rotating arm 82, as described above, by rotating into position with the half circular motivating portion of the ride vehicle's path to push the ride vehicle 14 or catch and pull the ride vehicle 14 depending on the configuration of the launching mechanism 80. Indeed, the various times (t1-t5) described above and the events that take place during each of the times may apply to the launching mechanism 80 and the turn table 84 embodiments alike.

Figure 12:
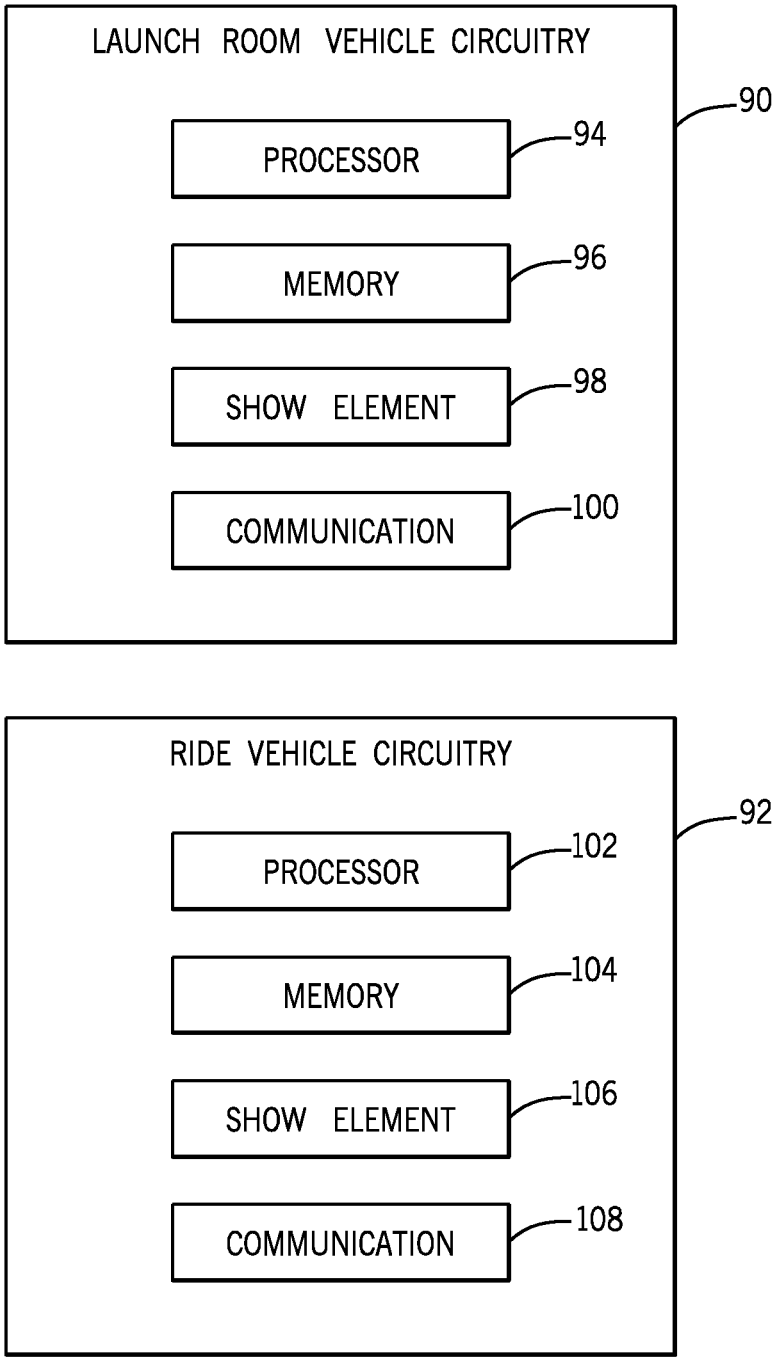
FIG. 12 is a block diagram of launch room circuitry and ride vehicle circuitry, in accordance with an embodiment.

FIG. 12 is a block diagram of launch room vehicle circuitry 90 (launching mechanism circuitry) and ride vehicle circuitry 92, in accordance with an embodiment. The launch room vehicle circuitry 90 may include a processor 94, a memory 96, a show element 98, and a communication module 100. The processor 94, which may represent one or more processors, may be any type of computer processor or microprocessor capable of executing computer-executable code. As previously mentioned 94, the processor 94 may be included in one or more automation controllers (e.g., programmable logic controllers (PLC)). The memory 96, which may represent one or more memory components, may be any suitable articles of manufacture that can serve as media to store computer-executable code, data, or the like. These articles of manufacture may represent tangible, non-transitory computer-readable media (e.g., any suitable form of tangible memory or storage) that may store the computer-executable code used by the processor 94 to perform the presently disclosed techniques. The memory 96 may also be used to store the media (e.g., video, audio, images) and command instructions (e.g., for an animatronic character) utilized by the show element 98 during the launching sequence. The show element 98, which may be one or more show elements, may include an animatronic character, a display device, a speaker, a fog machine, a strobe light, and so forth. As discussed above, the operation of the various show elements may be controlled by the processor executing the computer-executable code in sync with the movement of the launch room vehicle to create a desired experience. The display device may be any type of display device capable of displaying video files and the speaker may be any type of speaker capable of playing audio files. The communication module 100 may be a wireless communication component that may facilitate communication between the launch room vehicle and the ride vehicle and/or between the launch room vehicle and one or more external systems, such as a control system in a command center for the ride attraction. As such, the communication module 100 may include a wireless card capable of transmitting and receiving data.

Likewise, the ride vehicle circuitry 92 may include a processor 102, a memory 104, a show element 106, and a communication module 108. The processor 102, which may represent one or more processors, may be any type of computer processor or microprocessor capable of executing computer-executable code. As previously mentioned 94, the processor 94 may be included in one or more automation controllers (e.g., programmable logic controllers (PLC)). The memory 104, which may represent one or more memory components, may be any suitable articles of manufacture that can serve as media to store computer-executable code, data, or the like. These articles of manufacture may represent tangible, non-transitory computer-readable media (e.g., any suitable form of tangible memory or storage) that may store the computer-executable code used by the processor 102 to perform the presently disclosed techniques. The memory 104 may also be used to store the media (e.g., video, audio, images) and command instructions (e.g., for an animatronic character) utilized by the show elements 106 during the launching sequence. The show element 106, which may be one or more show elements, may include an animatronic character, a display device, a speaker, a fog machine, a strobe light, and so forth. As discussed above, the operation of the various show elements may be controlled by the processor executing the computer-executable code in sync with the movement of the launch room vehicle, the movement of the ride vehicle, and/or the operation of the launch room vehicle's show elements to create a desired experience. The animatronic character may engage underneath the ride vehicle or around the bumper. The display device may be any type of display device capable of displaying video files and the speaker may be any type of speaker capable of playing audio files. The communication module 108 may be a wireless communication component that may facilitate communication between the ride vehicle and the launch room vehicle and/or between the ride vehicle and one or more external systems, such as a control system in a command center for the ride attraction. As such, the communication module 100 may include a wireless card capable of transmitting and receiving data.

While only certain features of the present embodiments have been illustrated and described herein, many modifications and changes will occur to those skilled in the art. It is, therefore, to be understood that the appended claims are intended to cover all such modifications and changes as fall within the true spirit of the present disclosure. Further, it should be understood that certain elements of the disclosed embodiments may be combined or exchanged with one another.

The invention claimed is:

1. A system, comprising:

a ride vehicle disposed on a ride path; and a launch room vehicle configured to align with the ride vehicle on the ride path and including an at least partial room, the launch room vehicle configured to house the ride vehicle in the at least partial room and to move with the ride vehicle and then break coordination with the ride vehicle such that the ride vehicle launches along the ride path from the at least partial room.

2. The system of claim 1, wherein the launch room vehicle comprises a show element and is configured to operate the show element via circuitry as the at least partial room moves with the ride vehicle to simulate that the show element is interacting with the ride vehicle.

3. The system of claim 2, wherein the operation of the show element generates effects that increase in intensity as the launch room vehicle's speed increases and the effects culminate in a finale at or near the launch of the ride vehicle.

4. The system of claim 2, wherein the show element comprises one or more animatronic characters, displays, speakers, fog machines, strobe lights, or some combination thereof.

5. The system of claim 1, wherein the launch room vehicle is configured to propel the ride vehicle via contact with the ride vehicle and then slow or stop to launch the ride vehicle along the ride path.

6. The system of claim 5, wherein the launch room vehicle includes a bumper that contacts a bumper of the ride vehicle to propel the ride vehicle.

7. The system of claim 1, wherein the ride path comprises a first inner path upon which the ride vehicle is disposed and a second outer path upon which the launch room vehicle is disposed, the second outer path being adjacent and substantially parallel to the first inner path along a portion of the ride path.

8. The system of claim 1, wherein the ride path comprises a first lower path upon which the ride vehicle is disposed and a second higher path from which the launch room vehicle hangs.

9. The system of claim 8, wherein the second higher path is configured to incline up and away from the first lower path beginning at a point where the ride vehicle launches from the partial room.

10. The system of claim 1, wherein the launch room vehicle is attached to a rotatable arm pivoting from a center of a curved portion of the ride path.

11. The system of claim 1, wherein the launch room vehicle comprises a launching mechanism that is attached to an outer edge of a turn table and a portion of the ride path partially follows the outer edge of the turn table.

12. The system of claim 1, wherein the launch room vehicle is configured to launch the ride vehicle in a backwards or forward facing orientation.

13. A system, comprising:

a ride vehicle disposed on a first ride path; and a launch room vehicle disposed on a second ride path, the launch room vehicle comprising:

a left side wall;

a right side wall;

a back wall; and a ceiling, wherein the left side wall, right side wall, and back wall are each connected to the ceiling to form a partial room that includes a show element, the partial room being configured to house the ride vehicle, the show element being configured to operate synchronously with the movement of the launch room vehicle and the ride vehicle, and the launch room vehicle being configured to move with and propel the ride vehicle and to be break contact from the ride vehicle such that the ride vehicle launches from the partial room.

14. The system of claim 13, wherein the launch room vehicle is configured to break contact from the ride vehicle at a desired speed or at a stopping point on the second ride path.

15. The system of claim 14, wherein the stopping point comprises a barrier wall or stoppers fixed to the end of the second ride path.

16. The system of claim 13, wherein the launch room vehicle comprises a front wall including a retractable wall configured to open and close so that the ride vehicle can enter and exit the partial room through the front wall when the retractable wall is open.

17. The system of claim 13, wherein the ride vehicle includes a first bumper and the partial room includes a second bumper, wherein the first and second bumpers are in contact while the launch room vehicle propels the ride vehicle.

18. The system of claim 13, wherein the show element comprises one or more display devices, speakers, and animatronics, wherein the one or more display devices are configured to display media and the one or more speakers are configured to play audio synchronously with the operation of at least one of the animatronics and the movement of the launch room vehicle to simulate that the at least one of the animatronics is propelling the ride vehicle.

19. The system of claim 13, wherein the ride vehicle is configured to drive into the partial room and park, the show element is configured to operate when the ride vehicle is parked and while the launch room vehicle propels the ride vehicle, the first ride path is configured to switch configurations while the ride vehicle is parked in the partial room, and the launch room vehicle is configured to launch the ride vehicle backwards as the show element operates and to stop and reverse directions on the second path into its original position after the ride vehicle is launched.

20. A method, comprising:

driving a ride vehicle disposed on a first ride path via an initial path into a partial room of a launch room vehicle disposed on a second ride path;

parking the ride vehicle in the partial room;

operating one or more show elements included in the partial room;

switching the configuration of the first ride path to follow a different path than the initial path;

propelling the ride vehicle via the launch room vehicle on the different path and operating the one or more show elements synchronously with the movement of the launch room vehicle; and breaking contact between the launch room vehicle and the ride vehicle such that the ride vehicle launches from the partial room.

21. The method of claim 20, comprising resetting the launch room vehicle to its original position after the ride vehicle launches from the partial room.

22. The method of claim 20, comprising breaking contact between the launch room vehicle and the ride vehicle based on a desired speed of the launch room vehicle or at a stopping point for the launch room vehicle on the second ride path.

* * * * *